United States Patent [19]

Bishop

[11] Patent Number: 4,634,284

[45] Date of Patent: Jan. 6, 1987

[54] HAND-OPERATED MIXING DEVICE

[76] Inventor: Robert J. Bishop, 1083 Bloomfield Ave., West Caldwell, N.J. 07006

[21] Appl. No.: 783,680

[22] Filed: Oct. 3, 1985

[51] Int. Cl.[4] ..... B28C 5/18; B28C 5/20; B28C 7/16

[52] U.S. Cl. ..... 366/47; 366/57; 366/63; 366/185; 366/228

[58] Field of Search ..... 366/42, 44, 45, 46–48, 366/53–59, 60, 62, 63, 185, 187, 189, 213, 220, 224–228, 232, 606

[56] References Cited

U.S. PATENT DOCUMENTS

| | | | |
|---|---|---|---|
| 1,863,029 | 6/1932 | Piispanen | 366/47 |
| 2,478,408 | 8/1949 | Lightburn | 366/57 X |
| 4,197,015 | 4/1980 | Moser et al. | 366/47 |
| 4,223,997 | 9/1980 | Violet et al. | 366/60 X |
| 4,435,082 | 3/1984 | Bishop | 366/47 |
| 4,491,415 | 1/1985 | Bishop | 366/232 X |

*Primary Examiner*—Timothy F. Simone
*Attorney, Agent, or Firm*—Howard E. Thompson, Jr.

[57] ABSTRACT

A hand-operated mixing device is provided in which a mixing drum, having an open end, a closed end and divergently tapered circumferential walls extending from the ends to an enlarged diameter portion intermediate the ends, an annular groove at the outer periphery of the enlarged diameter portion, and the closed end having a detachably mounted crank member terminating in a bearing shaft coaxial with the drum axis, the drum being detachably mounted on a light-weight frame having at the forward portion thereof transversely spaced rollers for engagement with the annular groove, and at the rear portion thereof a bearing orifice detachably receiving the bearing shaft of the crank handle, the positioning of the rollers and bearing orifice being such as to orient the drum axis at an angle of about 10–20" to the horizontal to thereby elevate the open end of the drum, the light-weight frame being of knock-down construction having parts of such dimension as to permit packing when disassembled in a container adapted to closely receive the mixing drum, and the light-weight frame, when assembled, having wheels at the base of the frame and a handle at the rear portion thereof facilitating transport of the mixing drum and contents.

9 Claims, 11 Drawing Figures

HAND-OPERATED MIXING DEVICE

This invention relates to a mixing device of the rotary drum type particularly adapted for use by the home owner in the mixing of cement and other composites, such as potting soil and the like, and is unique in providing a detachable crank and handle member on the drum base and a circumferential groove at the large diameter of the drum cooperating with a knock-down base structure having forward and transversely spaced rollers for engagement with the drum groove and a bearing aperture for engagement with the crank and handle member to rotatably support the drum in an inclined position. The detachable crank and handle member and the element of the knock-down frame structure are of a size to permit packing, shipping and/or storing in a container attached to closely receive a drum of unitary structure or to receiving the nested components of a composite drum fashioned or nestable frustoconical sections.

BACKGROUND OF THE INVENTION

The mixing drum arc is extremely old and highly developed but there is little in this art relating to structures of the type needed by home owners and the like having infrequent occasions to engage in cement mixing or other mixing operations. What is needed for this market is a mixing device incorporating drum and frame structures of a knock-down nature so that storage and shipping costs can be minimized but which when assembled, provides a device which permits easy and practical mixing with a "professional touch".

Mixing devices essentially meeting these objectives have been disclosed and claimed in my prior U.S. Pat. Nos. 4,435,084 issued Mar. 6, 1984 and 4,491,415 issued Jan. 1, 1985. These devices incorporate a unitary frame with an inclined bearing member interfitting with an axial bearing socket on the drum to provide the sole support for the drum and contents with the inclined bearing member also providing mounting means for electrically powered or hand-actuated drive mechanisms. While such devices are extremely versatile, they fall short of filling the needs of home owners and the like for whom hand operation is preferred (because mixing will be done at locations remote from source of electrical power) and for whom mobility of the mixing device and contents after mixing is of primary importance.

THE INVENTION

It has now been found in accordance with the present invention that the needs of the home owner desiring hand mixing and requiring free mobility of the mixing device and contents can be met by modified structure in which a mixing crank integral with the drum detachably engages a bearing at the rear of the frame structure, an annular groove at the large diameter of the drum rotatably engages support rollers at the front portion of the frame, the frame is provided with wheels at either the front or rear portion thereof, and an elevated handle in substantial alignment with the crank bearing, facilitates easy tilting of the assemblage so that the mixing device and contents can be moved about on the wheels.

Regarded in certain of its broader aspects, the hand-operated mixing device of the present invention comprises a mixing drum, having an open end, a closed end and divergently tapered circumferential walls extending from said ends to an enlarged diameter portion intermediate said ends, means providing an annular groove at the outer periphery of said enlarged diameter portion, and the closed end having a detachably mounted crank member terminating in a bearing shaft coaxial with the drum axis, said drum being detachably mounted on a light-weight frame having at the forward portion thereof transversely spaced rollers for engagement with said annular groove, and at the rear portion thereof a bearing orifice detachably receiving the bearing shaft of said crank handle, the positioning of said rollers and bearing orifice being such as to orient the drum axis at an angle of about 10–20" to the horizontal to thereby elevate the open end of the drum, said light-weight frame being of knock-down construction having parts of such dimension as to permit packing when disassembled in a container adapted to closely receive said mixing drum, and said light-weight frame, when assembled, having wheels at the base of said frame and a handle at the rear portion thereof facilitating transport of the mixing drum and contents.

The support frame of the new mixing device is of knock-down structure facilitating compact storage and shipment and easy assembly and comprises similar side frame members suitably formed of metal tubing, shaped to provide parallel front and rear portions connected by a bottom portion with the rear portions being somewhat longer than the front portions as hereinafter described. The side frame members are joined together in spaced parallel relation by a detachable plate member adjacent upper ends of the rear portions and a detachable spacing member at the lower ends of the front frame portions.

This spacing member, in small adaptations of the invention can be a simple rod or tube, but in larger adaptations of the invention. It may be preferable to employ a plate member detachably secured to the front frame portions.

The front frame portions have detachably mounted at their upper ends, and on axes extending front to rear in the frame, small rollers, suitably about 3" in diameter, preferably fashioned from durable plastic material for rotatably supporting a mixing drum.

The plate member connecting upper rear portions of the frame is provided centrally thereof with an enlarged aperture carrying a bearing liner for detachably and rotatably receiving an axial bearing shaft carried by the drum. The bearing liner is suitably of two-part structure permitting clamping engagement with the plate and can be fashioned from bearing metal or preferably from durable plastic material.

The mixing drum is a thin-walled plastic structure suitably formed by blow molding, of circular cross section having a relatively small diameter open end, a relatively small diameter closed end with walls divergently tapering to a substantially enlarged diameter intermediate said ends. At its largest diameter the drum is provided with an annular groove for engagement with the rollers of said frame. The walls of the drum between the end portions and said groove are inwardly deformed at a plurality of equally spaced locations circumferentially of the drum to provide stiffening and mixing ribs. The number of such ribs can be in the range of about 4–8 with the number increasing with increase of the size of the drum.

Detachably secured to the closed end of the drum is a hand crank member terminating in a shaft portion coaxial with the drum axis and adapted to detachably engage the bearing liner on said plate. The hand crank member can suitably be fashioned from metal tubing deformed to provide a hand engaging portion parallel to the drum axis and located in general alignment with the large periphery of the drum, or about 10–12" from the bearing shaft portion of the crank.

In small adaptations of the invention the crank member can be secured to the drum with sufficient rigidity by bolts passing through the drum and crank member with small clamping plates in engagement with inner and outer surfaces of the drum bottom. In larger adaptations of the invention, however, where increased loads are to be carried by the drum, it is preferable to provide integral lateral extensions on the portion of the crank engaging the drum bottom to permit clamping of the drum and crank member at a plurality of circumferentially spaced locations.

The drum can comprise a unitary plastic body of general pear-shaped contour with the maximum diameter and annular groove being somewhat closer to the closed end than to the open end of the drum. Alternatively, the drum can be of a knockdown structure as more fully disclosed in my companion application filed concurrently herewith wherein two smaller frustoconical plastic parts, one with a closed end and the other with an open end and an annular ring member having opposed annular grooves in the radial surfaces thereof, and a roller engaging groove in the outer surface thereof, are joined together by a plurality of circumferentially spaced clamping means to sealably engage open ends of the frustoconical members with said opposed annular grooves.

It is desired that the mixing drum be supported with its axis at an inclination of about 10–20° to the horizontal with the open end elevated. The desired angularity is controlled by the lengths of the front and rear frame portions and the location of the front rollers and bearing insert in the rear frame plate. It should also be noted that the drum axis should be perpendicular to the rear frame plate. In providing this orientation it will be apparent that the parallel rear and front portions of the side frame parts will have an appropriate rearward inclination to be essentially perpendicular to the drum axis. The frame is provided with detachable wheels which can be located at either the lower front or lower rear portion of the frame and are preferably of a size to slightly elevate such portion of the frame so that when in use the wheels, extending laterally from the frame per se, add stability to the assemblage during mixing operations. Suitably frame parts are provided with both front and rear wheel mounting apertures giving the user the options whether, and at which location to employ the wheels. When added support and minimum mobility is desired, a front mounting of the wheels may be preferable; whereas, if a particular job is calling for extensive mobility, a rear mounting of the wheels may be preferred.

In order to facilitate moving about of the assemblage the frame is provided on the upper rear portion thereof with a handle member. This is preferably oriented in substantial alignment with the opper portion of the plate member, permitting easy assemblage by the use of elongated bolts passing through the plate member, associated rear frame portion, spacer of appropriate length and handle member. This orientation of the handle member permits easy movement of the mixing device and contents by applying slight upward force when using front mounted wheels and slight downward force when using rear mounted wheels.

The knock-down frame structure provides unit parts which can be readily packaged in a container of a size to receive the mixing drum; and when the mixing drum has maximum dimensions of 21" length and 21" diameter as a unitary structure all parts of the mixing device can be housed in a container of a size acceptable for United Parcel shipment. This compactness in the shipping container is an important factor in a device intended for general home owner use as minimizing storage and shipping costs minimize the overall cost to the consumer.

Minimizing overall cost to the consumer can be further enhanced by employing the alternate drum construction comprising nestable frustoconical parts. The saving in this instance is indirect and reflects primarily the savings in storage and handling between the supplier of drums and the supplier of complete mixing devices. It will be apparent that the nestable frustoconical drum parts make for a tremendous saving in space in the manufacture and transport of drums.

A detail of the mixing device assemblage as above described which contributes significantly to its versatility in use is the readily detachable locking means engaging the portion of the crank bearing shaft protruding through the bearing orifice in said plate. This locking means prevents axial movement of the crank bearing shaft when the mixing device is tilted to discharge drum contents. It is frequently desirable, however, to deliver drum contents to locations somewhat distant from a mixing station. In such event, removal of the locking device permits the drum and contents to be removed from the frame by grasping the crank handle and the open end of the drum, lifting and axially moving the drum to disengage the crank bearing shaft from the plate orifice and carrying the drum and contents to the desired place of use. As thus separated from the frame, it will be apparent that limited further mixing of drum contents can be accomplished by placing the drum on the ground and using the crank handle to impart oscillating rotary movements to the drum. This ability to accomplish further mixing at a remote place of use can be very useful in maintaining the desired consistency in the drum contents during an extended period of use.

Novel feature of the hand-operated mixing device in accordance with the present invention will be more fully understood from a consideration of the accompanying drawing in which preferred adaptations have been illustrated with the various parts thereof identified by suitable reference characters in the several views, and in which.

Figure 1:
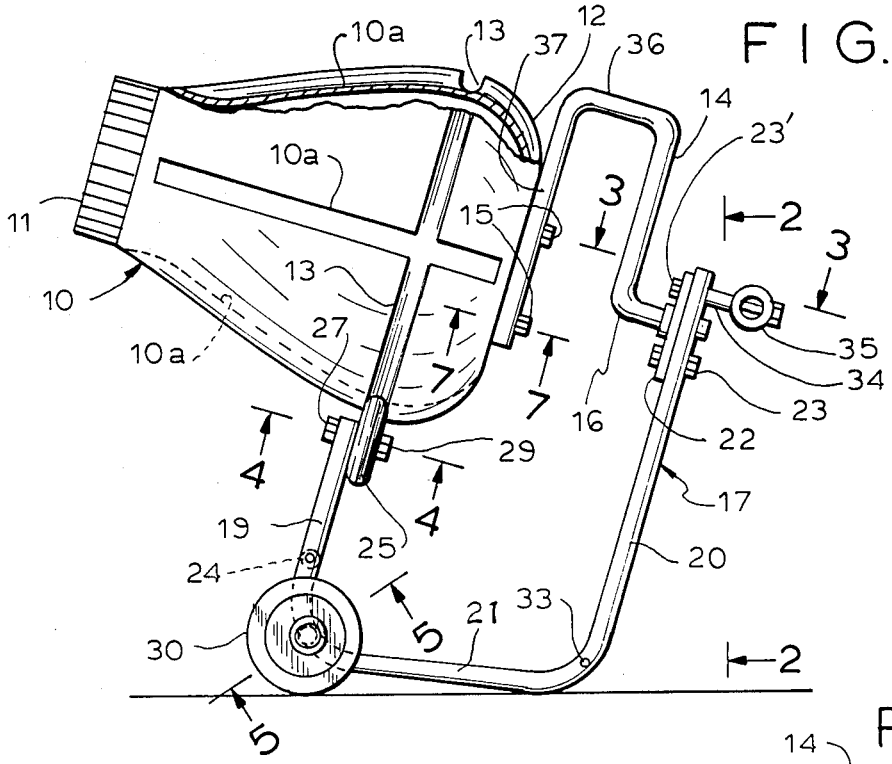
FIG. 1 is a side elevation view of a hand mixing device in accordance with the present invention incorporating a unitary drum structure.

As shown in FIGS. 1–9 in the drawings the hand operated mixing device comprises a mixing drum 10 of generally pear-shaped contour having an open end 11, a closed end 12 and an annular groove 13 at the maximum drum diameter with a crank handle 14 detachably secured by fasteners 15 to the drum bottom 12 and having a bearing shaft 16 coaxial with the drum axis, is detachably mounted in a frame 17 of knock-down construction.

The drum 10 is of sheet plastic construction suitably formed by blow molding and is provided with a plurality of circumferentially spaced and axially extending depressions 10*a* providing stiffening and mixing ribs. The drum as shown contains four such ribs but, depending on the size of the drum, the number of ribs can vary within the range of about 3–6.

The frame 17 comprises tubular side members 18 deformed to provide parallel upstanding front portion 19, rear portion 20 and connecting bottom portion 21. These side members are joined together in parallel relation by a plate 22 secured by fasteners 23, 23′ to the upper ends of rear frame portions 20 and by a connecting spacer 24 secured to lower ends of the front frame portions 19.

Upper ends of the front frame portions 19 carry rollers 25 for rotatable engagement with drum groove 13. As more clearly shown in FIG. 4, the roller 25 rides on a tubular bearing member 26, clamped to the front frame portion 19 by bolt 27, passing through the members 19, 26 and washer 28 and secured by nut 29. The length of the bearing 26 is sufficiently greater than the hub thickness of roller 25 to assure free rotation of the roller.

Figure 5:
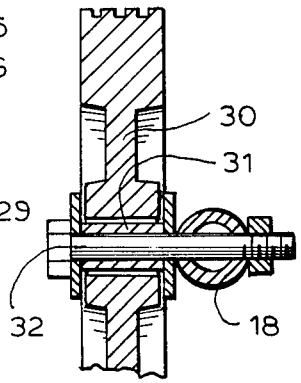
FIG. 5 is a fragmentary sectional view substantially on the line 5,5 of FIG. 1.

As shown in FIG. 1, the forward end of the frame 17 is provided with wheels 30. As shown in FIG. 5, the wheels 30 are rotatably mounted on bearing 31, and detachably secured to the frame by bolt 32, passing through bearing 31 and side member 18. It should be noted in this connection that the wheels 30 can, if desired, be mounted at the rear portion of the frame for which purpose apertures 33 are provided in the lower portion of rear frame members 20.

Figure 3:
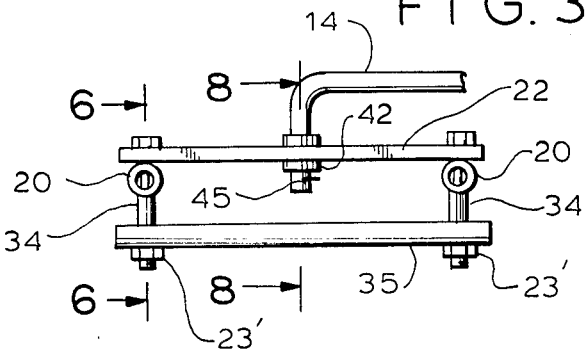
FIG. 3 is a fragmentary sectional view of line 3,3 of FIG. 1.
Figure 2:
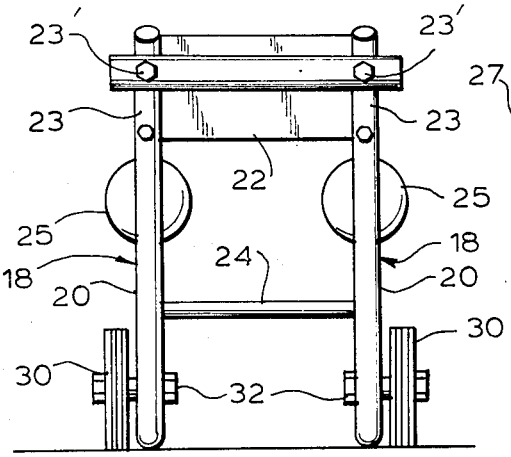
FIG. 2 is a view of the frame structure taken in the direction of the arrows 2,2 in FIG. 1.
Figure 4:
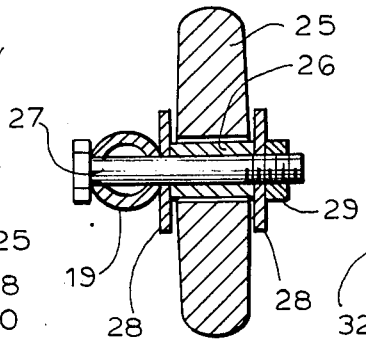
FIG. 4 is a fragmentary sectional view substantially on the line 4,4 of FIG. 1.
Figure 6:
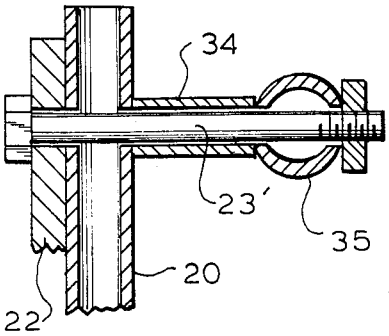
FIG. 6 is a fragmentary sectional view substantially on the line 6,6 of FIG. 3.

As shown in FIGS. 1 and 3, the joining of plate 22 to the rear frame members 20 involves the use of short lower bolts 23 and long upper bolts 23′, as more clearly shown in FIG. 6, passing through plate 22 rear frame member 20 spacer 34 and a transverse tubular member 35 providing a handle for the frame.

Figure 7:
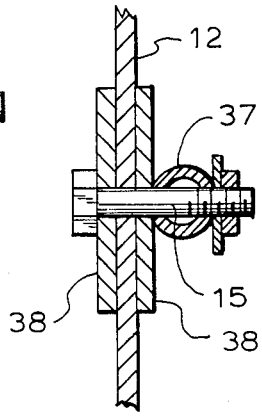
FIG. 7 is a fragmentary sectional view substantially on the line 7,7 of FIG. 1.

The crank 14 is a deformed tubular member providing the bearing shaft 16 coaxial with the drum and offset hand grip portion 36 and a mounting portion 37 through which fasteners 15 are passed in securing crank 14 to drum 10. As shown in FIG. 7, the bolt or fastener 15 passes through stiffening plate members 38, engaging inner and outer surfaces of drum bottom 12 in clamping mounting end 37 of the crank to the drum. The plate members 38 may be 1″ to 3″ in diameter or larger as needed to support the crank 14 against twisting movement with respect to the drum, and in small adaptations of the inventions, the plate members 38 will provide ample support. In larger adaptations it may be desirable to fashion mounting end 37 of the crank 14 to have a Y-shaped or cross shaped contour so that fasteners 15 can be located respectively at three or four circumferentially spaced locations on the drum bottom 12.

Figure 8:
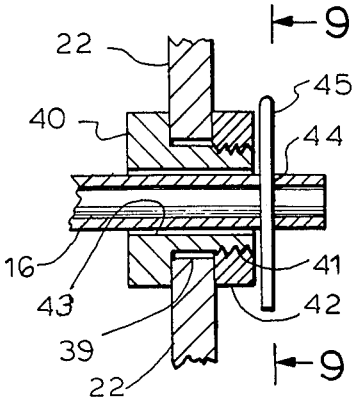
FIG. 8 is a fragmentary sectional view substantially on the line 8,8 of FIG. 3.
Figure 9:
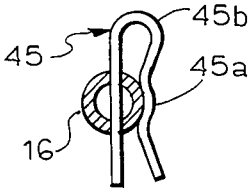
FIG. 9 is a sectional view substantially on the line 9,9 of FIG. 8.
Figure 11:
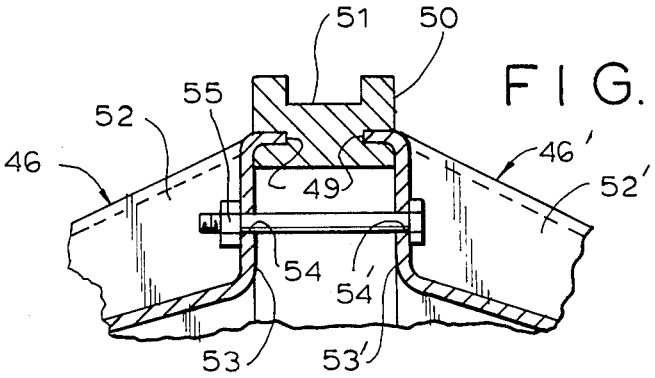
FIG. 11 is a sectional view substantially on the line 11,11 of FIG. 10.

The plate 22 as more fully shown in FIG. 8 is provided with a central aperture 39 through which is passed a flanged bearing liner 40, having a threaded protuding end 41 receiving clamp ring 42 and having an inner diamter 43 such as to freely receive bearing shaft 16 of the crank. The bearing liner 40, 42 can be formed of appropriate bearing metal, but is preferably formed of durable plastic material. The portion of bearing shaft 16 protruding through bearing liner 40 is provided with transaxial aperture 44 for receiving spring clamp 45. As shown in FIG. 9, the spring clamp 45 has a central offset 45*a* which interlocks with the bearing shaft 16 with such interlocking being readily released by pulling a loop portion 45*b*.

Figure 10:
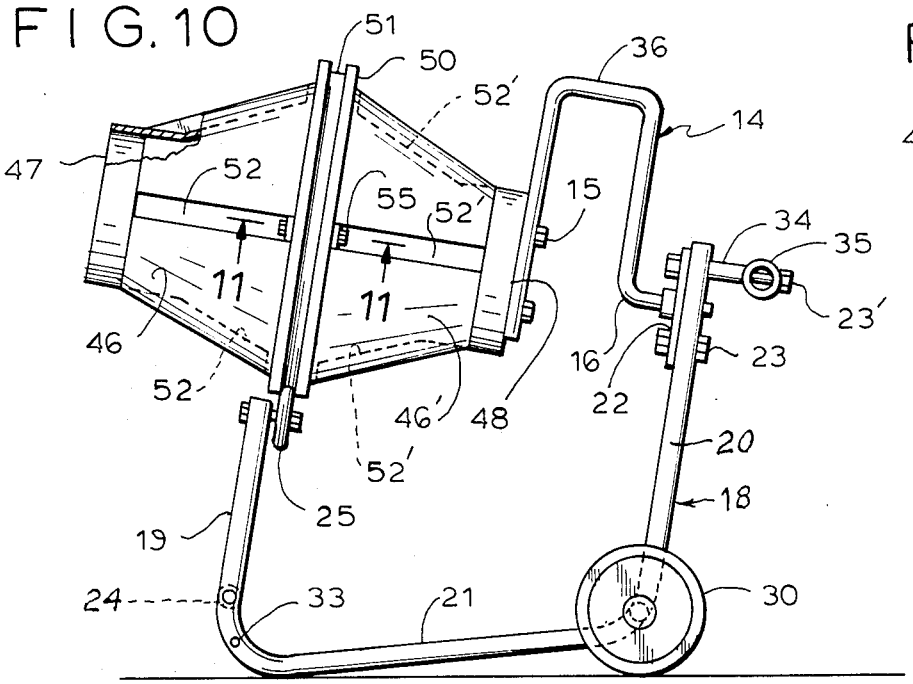
FIG. 10 is a view similar to FIG. 1 in which the drum is a composite structure of two frustoconical parts sealably joined together by a central sealing ring.

In the modification shown in FIG. 10 the unitary pear-shaped drum has been replaced by a composite drum made up of similar frustoconical sections 46 having an open end 47, and 46′ having a closed end 48, with the large ends of the frustoconical sections sealably engaging annular grooves 49 in a ring member 50 having an annular groove 51 in the outer perimeter thereof for engagement with rollers 25.

The frustoconical sections, 46, 46′ have a plurality of circumferentially spaced depressions 52, 52′ forming stiffening and mixing ribs terminating in radial end portions 53, 53′ having apertures 54, 54′ for receiving bolts 55 for adjustably drawing the frustoconical sections into close sealing engagement with the opposed grooves 49 in ring member 50.

When disassembled it will be apparent that the frustoconical drum members 46, 46′ can be nested one within the other, providing substantial space saving in storage, handling and shipping of the drum sections.

The components of the frame structure, with the adaptations shown in FIG. 10, are generally similar to those shown in FIGS. 1 to 9 and have been similarly numbered in FIG. 10. The slight differences in size of the parts to accommodate the FIG. 10 location of annular groove 51 at the mid-section of the drum involves primarily a slight elongation of the bottom connecting portion 21 of the side frame members 18 and appropriate adjustment in the lengths of the front frame members 19 and rear frame members 20. It will also be noted that in FIG. 10 the wheels 30 have been shown as mounted in the alternate positions at the rear portion of frame 17. It will be noted in this connection that the user, depending upon his needs for a particular project, has the options of using the device without wheels, mounting the wheels at the front of the device or mounting the wheels at the rear of the device.

Various changes and modifications in the hand-operated mixing device as herein disclosed may occur to those skilled in the art, and to the extent that such changes and modifications are embraced by the appended claims, it is to be understood that they constitute part of the present invention

I claim:

1. A hand-operated mixing device comprising a mixing drum, having an open end, a closed end, and an outer periphery radially spaced from an axis of rotation passing through said ends, said outer periphery being formed by divergently tapered circumferential walls extending from said ends to an enlarged diameter portion intermediate said ends, means providing an annular groove at the outer periphery of said enlarged diameter portion, and the closed end having a detachably mounted crank member terminating in a bearing shaft coaxial with the drum axis, said drum being detachably mounted on a light-weight frame having spaced forward and rear portions disposed perpendicularly to said drum axis, said frame having at the forward portion thereof transversely spaced rollers for engagement with said annular groove, and at the rear portion thereof a bearing orifice detachably receiving the bearing shaft of said crank handle, the positioning of said rollers and bearing orifice being such as to orient the drum axis at an angle of about 10°–20° to the horizontal to thereby elevate the open end of the drum, said light-weight frame being of knockdown construction having parts of such dimension as to permit packing when disassembled in a container adapted to closely receive said mixing drum, and said light-weight frame, when assembled, having wheels at the base of said frame and a handle at the rear portion thereof facilitating transport of the mixing drum and contents.

2. A hand-operated mixing device as defined in claim 1, wherein said drum is a unitary thin-walled plastic member of generally pear shaped contour formed to provide a plurality of circumferentially spaced stiffening and mixing ribs, and to provide, at its largest diameter, a shallow annular groove for engagement with said transversely spaced rollers.

3. A hand-operated mixing device as defined in claim 1, wherein said drum is a composite structure comprising two frustoconical thin-walled plastic members, one of which is open and the other closed at the small end thereof, and an annular ring member having aligned grooves in the radial surfaces thereof for receiving the large ends of said frustoconical members, a plurality of circumferentially spaced clamping means for joining together such frustoconical members in a sealing engagement with said aligned grooves, and the outer surface of said ring member having a shallow annular groove for engagement with said transversely spaced rollers.

4. A hand-operated mixing device as defined in claim 1 wherein said frame is of knockdown structure comprising similar tubular side members deformed to provide parallel upstanding front and rear portions connected by base portions, means joining said side members in parallel spaced relation, said means being located at the lower front portion and the upper rear portion of said side members, the means joining upper rear portions of said side members being a plate with said bearing orifice located centrally thereof, said plate being joined to said upper ends of the side members by vertically spaced detachable coupling means, the uppermost of said coupling means simultaneously joining to said frame a handle member rearwardly spaced with respect to said plate, and said frame having wheels secured to said side members at either the front or rear portion of said frame.

5. A hand-operated mixing device as defined in claim 4, wherein said wheels are at the front portion of said frame, whereby movement of said mixing device is possible with slight upward force on said handle.

6. A hand-operated mixing device as defined in claim 4, wherein the wheels are at the rear portion of said frame, whereby movement of said mixing device is possible with slight downward force on said handle.

7. A hand-operated mixing device as defined in claim 4, wherein the front and rear portion of said side members in the assembled frame are disposed in planes which are perpendicular to the axis of said drum, whereby the center of gravity of said drum and contents is aligned with said base portions of the frame side members.

8. A hand-operated mixing device as defined in claim 4, werein the bearing orifice in said plate is provided with an annular liner rotatably receiving the bearing shaft of said crank.

9. A hand-operated mixing device as defined in claim 8, wherein means is provided on a portion of said bearing shaft protruding through said bearing orifice liner for detachably receiving a lock member preventing axial movement of said bearing shaft as the device is tilted to discharge drum contents.

* * * * *